US006254430B1

(12) United States Patent
Endo et al.

(10) Patent No.: US 6,254,430 B1
(45) Date of Patent: Jul. 3, 2001

(54) COAXIAL CONNECTOR

(75) Inventors: Takayoshi Endo; Kiyohito Fukuda, both of Shizuoka-ken; Yasuo Yoshiura, Tokyo, all of (JP)

(73) Assignees: Yazaki Corporation; SMK Corporation, both of (JP)

( * ) Notice: Subject to any disclaimer, the term of this patent is extended or adjusted under 35 U.S.C. 154(b) by 0 days.

(21) Appl. No.: 09/499,786

(22) Filed: Feb. 8, 2000

(30) Foreign Application Priority Data

Feb. 9, 1999 (JP) ..... 11-030960

(51) Int. Cl.[7] ..... H01R 9/05
(52) U.S. Cl. ..... 439/578; 439/438; 439/439
(58) Field of Search ..... 439/578–585, 439/439–441, 445, 394, 816–818, 574, 575, 607, 579

(56) References Cited

U.S. PATENT DOCUMENTS 3,977,752 * 8/1976 Freutag ..... 339/95
4,133,594 * 1/1979 Laverick et al. ..... 339/95
5,651,699 * 7/1997 Holliday ..... 439/585

* cited by examiner

*Primary Examiner*—Gary Paumen
*Assistant Examiner*—Alexander Gilman
(74) *Attorney, Agent, or Firm*—Morrison Law Firm

(57) ABSTRACT

A connection part has at least two matingly interengaging contact pieces that electrically connect the central conductor of a coaxial cable without soldering or trimming. In the preferred embodiment, the connection part includes a bifurcated segment and another segment resiliently disposed between the bifurcated segment. A jig is inserted through an opening into the connection part, separating and pushing the segments apart, creating a space where the central conductor of a coaxial cable is inserted. The central conductor is pressed against a groove formed by an arcuate section of the connection part segments. When the jig is removed, the resilient action of the segments grip and bend the central conductor holding it firmly and electrically connecting it to the connection part. Bendable cover pieces close the opening. An insulative covering closes and protects the coaxial connector. Grounding arms are connected to the shielding conductor of the coaxial cable and project from slots in the insulative covering. A clamping section clamps the outermost layer of the coaxial cable securing it to the coaxial connector.

19 Claims, 8 Drawing Sheets

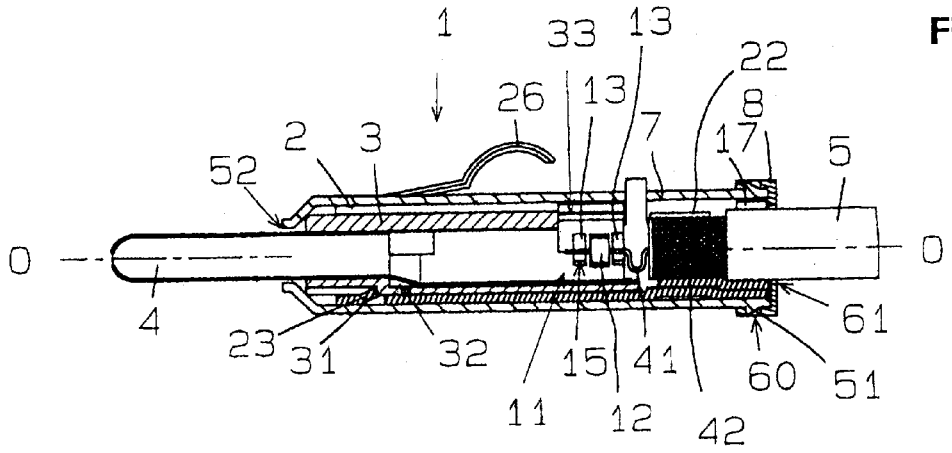
Fig. 3
Fig. 4
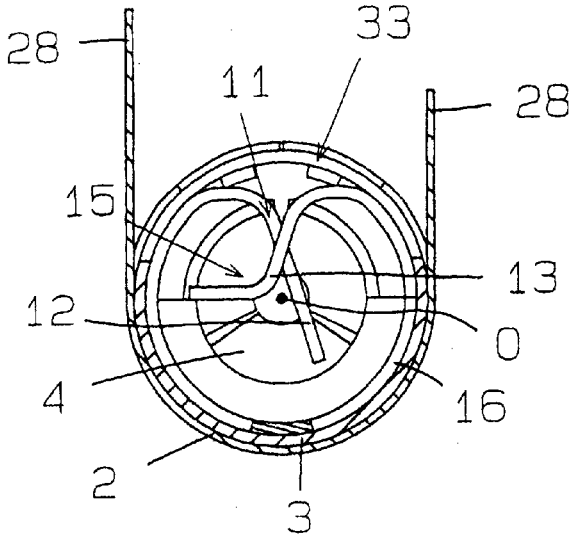

COAXIAL CONNECTOR

BACKGROUND OF THE INVENTION

The present invention relates to a coaxial connector for connecting a coaxial cable to electrical equipment or the like. More particularly, it relates to a coaxial connector whose central contact makes resilient contact with a central conductor of a coaxial cable to establish electric connections between the connector and the cable without the use of solder and without the need to trim the central conductor after connecting.

Referring to FIG. 12, it is customary in the prior art to connect a coaxial cable 104 and a coaxial connector 100 by soldering the tip of a central conductor 105 to a plug pin 103. A clamping part 107 clamps a shielded conductor 106 that surrounds central conductor 105.

The following is a brief description of a prior art procedure for connecting coaxial connector 100 to coaxial cable 104. To begin with, plug pin 103, ultimately serving as a central contact, is forced into an insulating housing 102. An external contact 101 is slid over and fixed to insulating housing 102. Then, central conductor 105 of coaxial cable 104 is prepared by stripping and exposing a long portion of central conductor 105 and stripping and exposing a much smaller portion of shielded conductor 106. The stripped forward end portion is inserted into plug pin 103 and passes through a hole 108. Shielded conductor 106 is clamped by clamping part 107. Clamping part 107 electrically connects shielded conductor 106 to external contact 101. Coaxial cable 104 is also clamped by clamping part 107 along with shielded conductor 106, and hence it is fixed to coaxial connector 100.

Central conductor 105 is soldered to the tip of plug pin 103. The portion of central conductor 105 projecting out of hole 108 is trimmed away. Next, an insulating cover 109 is mounted on the connector assembly with a contact piece 110 of external contact 101 protruding through a cutout (not shown) in insulating cover 109. The above is atypical prior art procedure to connect coaxial connector 100 to coaxial cable 104.

With the conventional coaxial connector it is necessary to solder central conductor 105 to the tip of plug pin 103. After soldering, it is also necessary to cut off the portion of central conductor 105 that projects beyond hole 108. The soldering and cutting requirements complicate the assembly of a prior art coaxial connector to a coaxial cable and hence increases manufacturing costs. It also increase the time it takes to assemble the coaxial connector in the field. In addition, such solder joints are a frequent cause of poor connections.

OBJECTS AND SUMMARY OF THE INVENTION

It is an object of the invention to provide a coaxial connector that overcomes the limitations of the prior art.

It is another object of the invention to provide a coaxial connector that is easily assembled.

It is another object of the invention to provide a coaxial connector which does not require soldering, thus reducing the cost and time required to connect a coaxial cable to a connector.

It is another object of the invention to provide a coaxial connector which does not require trimming after connecting, thus reducing the time spent connecting a coaxial cable to a connector.

It is yet another object of the invention to provide a coaxial connector that is cheaper to manufacture than the prior art.

Briefly stated, the present invention provides a connection part that has at least two matingly interengaging contact pieces that electrically connect the central conductor of a coaxial cable without soldering or trimming. In the preferred embodiment, the connection part includes a bifurcated segment and another segment resiliently disposed between the bifurcated segment. A jig is inserted through an opening into the connection part, separating and pushing the segments apart, creating a space where the central conductor of a coaxial cable is inserted. The central conductor is pressed against a groove formed by an arcuate section of the connection part segments. When the jig is removed, the resilient action of the segments grip and bend the central conductor holding it firmly and electrically connecting it to the connection part. Bendable cover pieces close the opening. An insulative covering closes and protects the coaxial connector. Grounding arms are connected to the shielding conductor of the coaxial cable and project from slots in the insulative covering. A clamping section clamps the outermost layer of the coaxial cable securing it to the coaxial connector.

According to an embodiment of the invention there is provided a coaxial connector comprising: a plug pin having a connection part; the connection part having at least two contact pieces that matingly interengage; and means for permitting urging of a central conductor against metal springback between the at least two contact pieces whereby the central conductor is positionable between same, the central conductor is resiliently retained between the at least two contact pieces by the metal springback without requiring soldering for mechanical and electrical connection.

According to another embodiment of the invention, there is provided a coaxial connector for attachment to a coaxial cable which has been prepared by stripping back an outer conductor exposing a portion of an inner conductor, comprising: an external contact; a plug pin coaxially disposed in the external contact; means for electrically isolating the external contact from the plug pin; the plug pin having a plug end extending beyond an end of the external contact; the external contact having at least one external contact surface for contacting a socket; the plug pin also having a connection part disposed at an other end; the connection part having at least two contact pieces that matingly interengage; and means for urging a central conductor against metal springback between the at least two contact pieces whereby the central conductor is positionable between same, the central conductor is resiliently retained between the at least two contact pieces without requiring soldering for mechanical and electrical connection.

According to yet another embodiment of the invention, there is provided a coaxial connector comprising: a plug pin having a connection part; the connection part having at least two contact pieces that resiliently interengage; and means for temporarily urging the at least two contact pieces apart forming a channel, whereby the central conductor is insertable in the channel and once the central conductor is inserted in the channel, the at least two contact pieces resiliently move back together deforming the central conductor, resiliently retaining the central conductor against axial forces without requiring soldering for mechanical and electrical connection.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 3 is a longitudinal sectional view of the coaxial connector of FIG. 1 taken along its center axis.

FIG. 4 is a cross sectional view of the coaxial connector of FIG. 1, showing the connection part 11 with no central conductor of the coaxial cable connected thereto.

DETAILED DESCRIPTION OF THE PREFERRED EMBODIMENT

Figure 1:
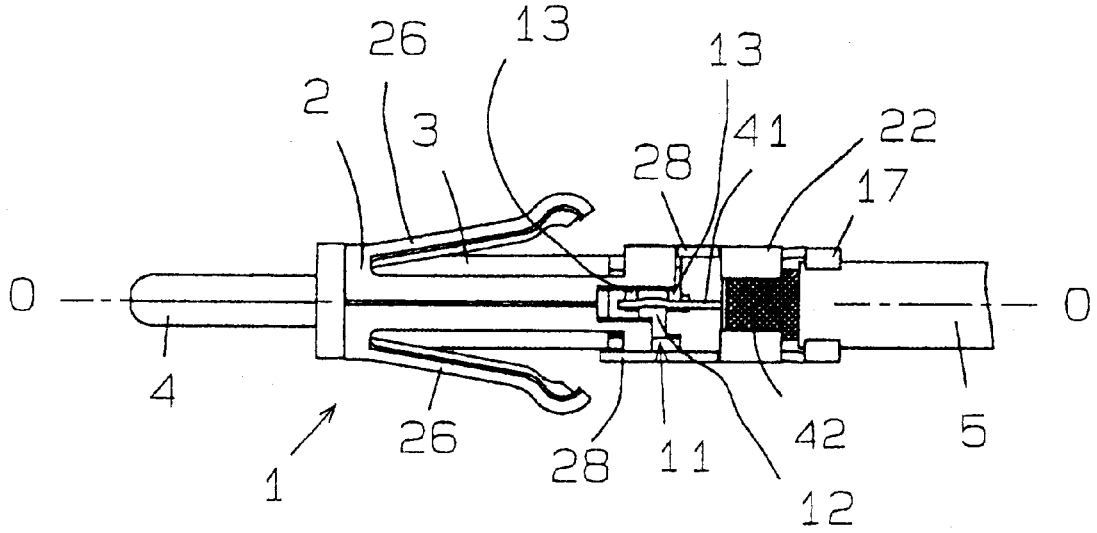
FIG. 1 is a plan view, partly cut away, illustrating the coaxial connector according to the present invention with a coaxial cable connected thereto.
Figure 2:
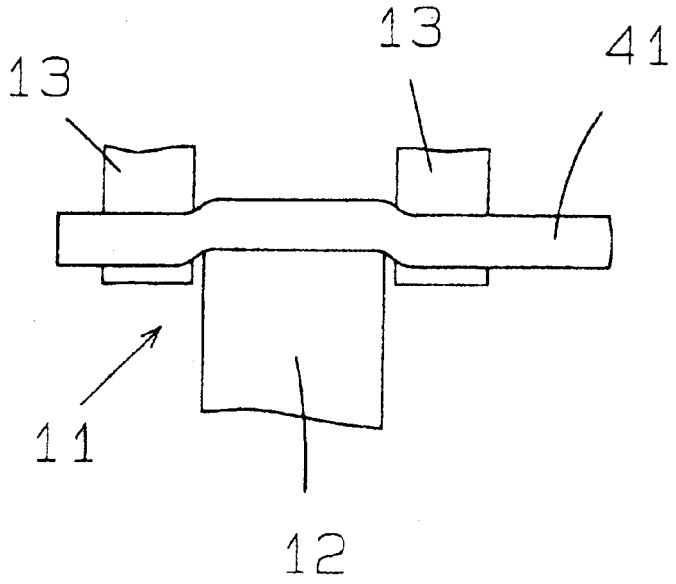
FIG. 2 is an enlarged plan view of a connection part 11 of the coaxial connector depicted in FIG. 1.
Figure 8:
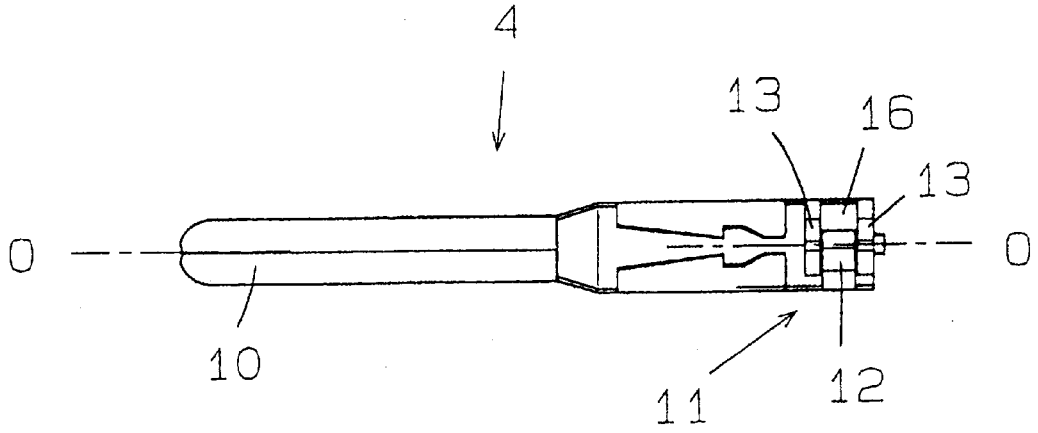
FIG. 8 is a plan view of a plug pin 4 that serves as the central contact 4.

Referring to FIGS. 1, 3 and 8, a coaxial connector 1 includes a cylindrical insulating housing 3. A plug pin 4 is supported in a cylindrical hollow 32. Cylindrical hollow 32 is disposed in insulating housing 3. An external contact 2 slides over insulating housing 3. An insulating cover 7 covers external contact 2. An insulating cap 8 covers the rearward end of insulating cover 7.

Plug pin 4, which serves as a central contact, is produced by stamping or die-cutting a metal sheet and bending it into a slender cylinder. The forward portion (left-hand side) of plug pin 4 is a plug contact part 10 for contact with a signal terminal of a mating connector (not shown). The rearward portion of plug pin 4 is a connection part 11 for electrical connection with a central conductor 41 of a coaxial cable 5.

Referring to FIGS. 2–4 and 8, connection part 11 includes a U-shaped contact piece body 16, a first contact piece 12, and a second contact piece 13. First contact piece 12 and second contact piece 13 are matingly interengageable. U-shaped contact piece body 16 is formed by arcuately bending the rearward portion of plug pin 4 about a center axis O longitudinally parallel to plug pin 4. First and second contact pieces 12 and 13, respectively, are formed by bending both end portions of contact piece body 16 around center axis O.

Second contact piece 13 is bifurcated providing parallel segments with first contact piece 12 disposed between them. First and second contact pieces 12 and 13 are inwardly bent from both sides of contact piece body 16 so that they matingly interengage around center axis O. Plug pin 4 fits into insulative housing 3 in the same direction (from left to right in the Figs.) in which coaxial cable 5 is inserted into coaxial connector 1. Plug pin 4 is longitudinally fixed within insulating housing 3. This arrangement ensures that center axis O of plug pin 4 is in alignment with the insertion direction coaxial cable 5 and substantially in alignment with the direction of the projection of central conductor 41. The bifurcated second contact piece 13 has its two segments arcuately bent forming an L-shaped groove 15 for positioning central conductor 41.

Figure 9:
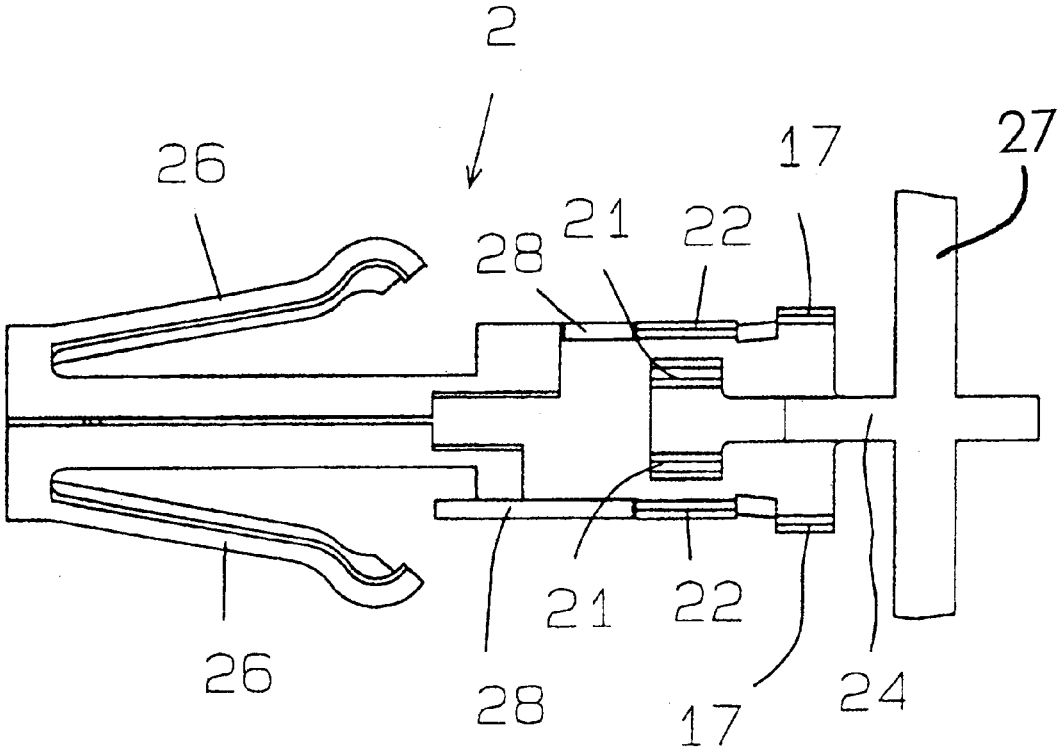
FIG. 9 is a plan view of the external contact 2.
Figure 10:
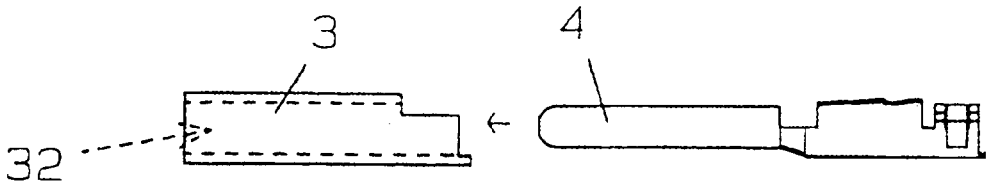
FIGS. 10(*a*) through 10(*e*) are schematic diagrams illustrating a sequence of steps involved in assembling the coaxial connector according to the present invention.
Figure 10:
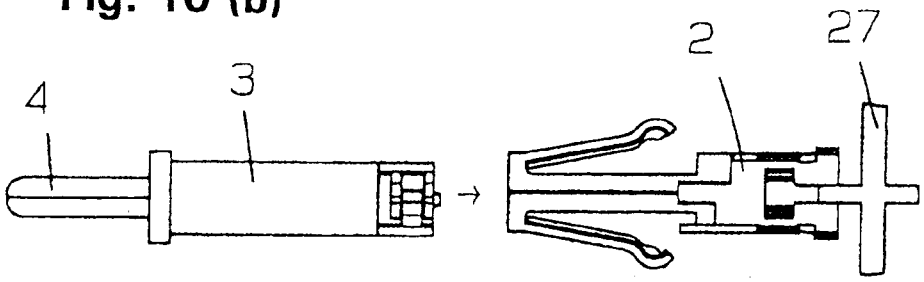
Figure 10:
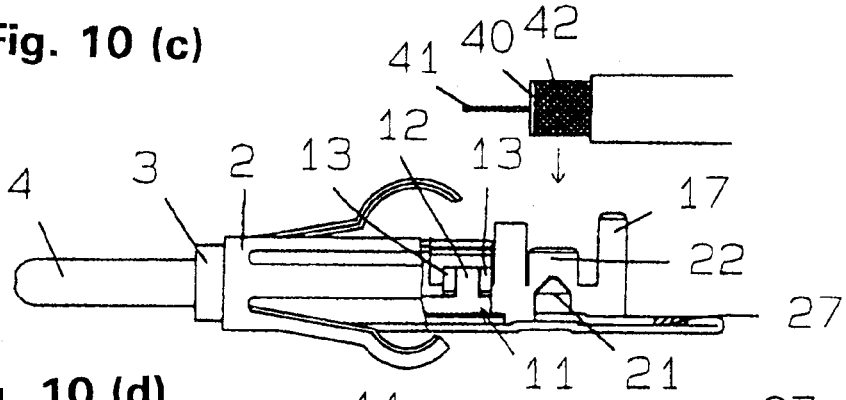
Figure 10:
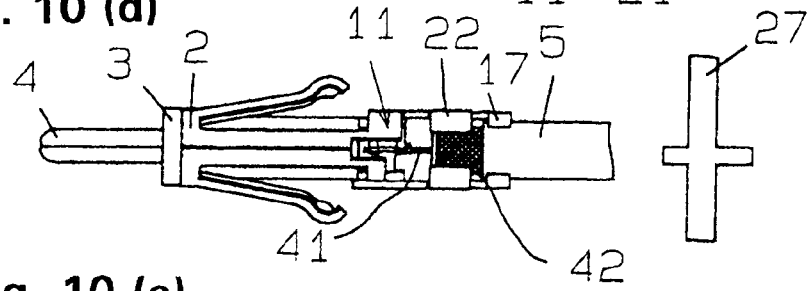
Figure 10:
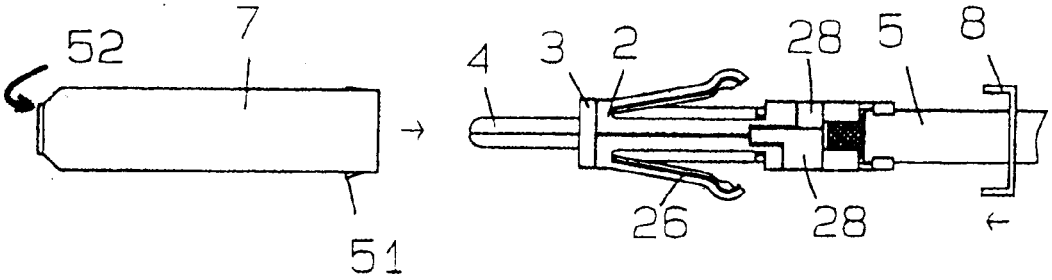

Referring to FIGS. 3, 9 and 10(*a*)–(*e*), external contact 2 is formed as a cylinder covering the surface of insulating housing 3 described later. External contact 2 has a plurality of contact pieces 26 extending obliquely rearward from its forward end portion. Contact pieces 26 each have a circularly arcuate extremity, which make contact with a grounding terminal (not shown) of a mating connector (not shown.) At the bottom of the forward end portion of external contact 2, there is an inward lug 23 that engages a stepped portion of insulating housing 3, securing it to external contact 2.

A pair of cover pieces 28 are integrally formed on contact piece 2. A U-shaped outer clamping portion 22 and a cable sheath clamping portion 17 are also integrally formed on contact piece 2. Cover pieces 28 cover the upper portion of connection part 11. Outer clamping portion 22 clamps a shielded conductor 42 of coaxial cable 5. Cable sheath clamping portion 17 clamps the outermost layer of the cable sheath of coaxial cable 5.

A coupling piece 24 integrally extends from the rear of external contact 2. Coupling piece 24 is generally U-shaped and extends beyond outer clamping portion 22. Coupling piece 24 also includes a U-shaped inner clamping portion 21. When shielded conductor 42 is clamped by outer clamping portion 22, inner clamping portion 21 is pressed into coaxial cable 5 between an inner insulator 40 and shielded conductor 42.

External contacts 2 are manufactured connected to other external contacts 2. Each external contact 2 includes a carrier 27 joined to an intermediate portion of coupling piece 24. Each external contact 2 is severed from the others prior to assembling.

Referring now to FIGS. 3, 4 and 10(*e*), insulating housing 3 has a cylindrical hollow 32 extending longitudinally from the front to the back of insulative housing 3. Along the outer periphery of insulating housing 3, a stepped portion 31 engages inward lug 23 of external contact 2. An upward opening cutout 33 is disposed in the rear portion of insulating housing 3. Central conductor 41 can easily be pressed into contact with connection part 11 through cutout 33.

Insulating cover 7 is generally cylindrical and covers the outer peripheral surface of external contact 2. Contact pieces 26 protrude through cutouts (not shown) in insulating cover 7. Insulating cover 7 protects external contact 2 and fixes it to insulating housing 3. Insulating cover 7 has a projection 51 on its rearward end. Insulating cover 7 has a through hole 52 at its forward end through which plug pin 4 passes.

The rearward end of insulating cover 7 is covered with insulating cap 8. Insulating cap 8 has a hole 60 for receiving projection 51 of insulating cover 7. Coaxial cable 5 is inserted into coaxial connector 1 through a through hole 61 in insulating cap 8.

Referring to FIGS. 3–7 and 10(*a*)–(*e*) coaxial connector 1 is assembled by pressing plug pin 4 into cylindrical hollow 32 through the rearward end of same. External contact 2 is formed by stamping or die-cutting a sheet metal into a contact blank and bending it as described supra. Then, the assembly shown in FIG. 10(*a*) is inserted into external contact 2 from the frontward end of external contact 2. Lug 23 slides against stepped portion 31 of insulating housing 7. Lug 23 engagingly secures external contact 2 to the outside of insulating housing 3.

Shielded conductor 42 and central conductor 41 of coaxial cable 5 are stripped. Central conductor 41 is connected to connection part 11 and shielded conductor 42 is connected to external contact 2. The connection between central conductor 41 and connection part 11 will be described in detail infra.

Central conductor 41 of coaxial cable 5 is initially positioned slightly above connection part 11 near central axis O as coaxial cable 5 is inserted into external contact 2 from its rearward end. Accordingly, stripped central conductor 41 lies just above contact pieces 12 and 13 of connection part 11. Next, a jig 50, is guided through cutout 33 in insulating housing 3. In this position, central conductor 41 is straddled by pressing projections 53 of jig 50. The structure of jig 50 is described infra. As jig 50 is guided into the position shown in FIG. 5, first and second contact pieces 12 and 13 are pressed apart by the bottom of jig 50. Central conductor 41 is guided down and aligned along central axis O by jig 50 into groove 15 defined by the two segments of second contact piece 13.

Upon removal of jig 50, first and second contact pieces 12 and 13 go back towards their initial positions by their own resiliency. Central conductor 41 is guided down against groove 15 and is urged against second contact piece 13 by first contact piece 12. This securely positions central conductor 41 in groove 15. Central conductor 41 is firmly held between first and second contact pieces 12 and 13 which are electrically connected to plug pin 4. Central conductor 41 is easily bent by a slight external force. Thus the resilient action of first and second contact pieces 12 and 13 bends the small portion of central conductor 41 that is held between first and second contact pieces 12 and 13. This provides a secure electrical connection between central conductor 41 and connection part 11 at a plurality of places preventing central conductor 41 from easily dislodging.

Figure 5:
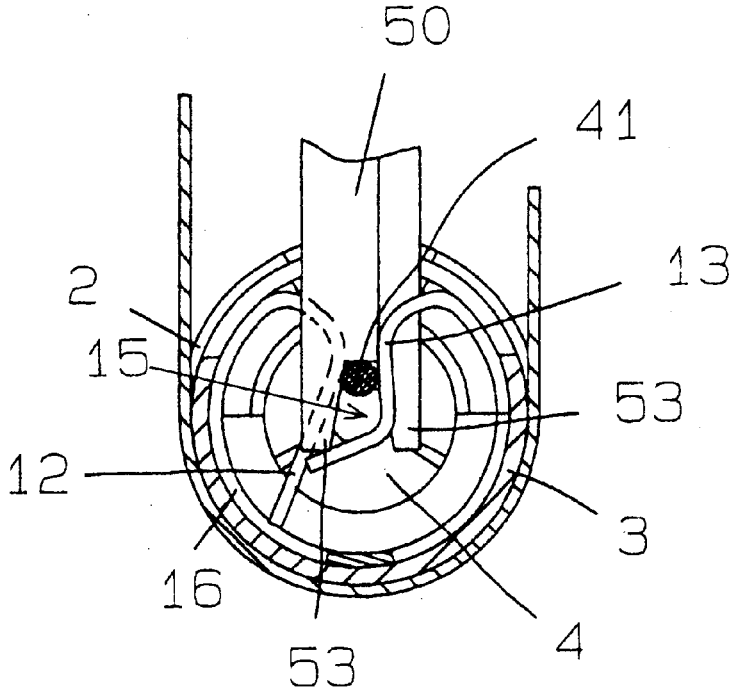
FIG. 5 is a cross sectional view of the coaxial connector, showing how a central conductor 41 of the coaxial cable is inserted into the connection part 11 by means of a jig 50.
Figure 6:
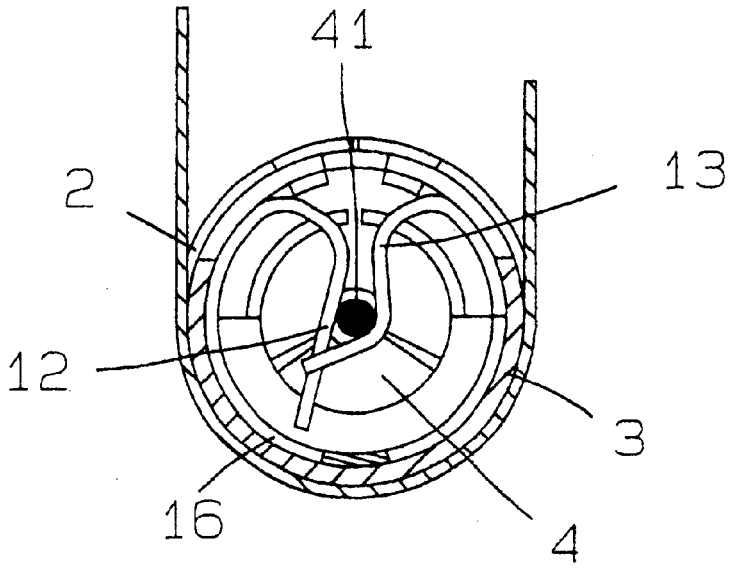
FIG. 6 is a cross sectional view of the coaxial connector, showing the connection part 11 having received in its groove 15 the central conductor 41 of the coaxial cable.
Figure 11:
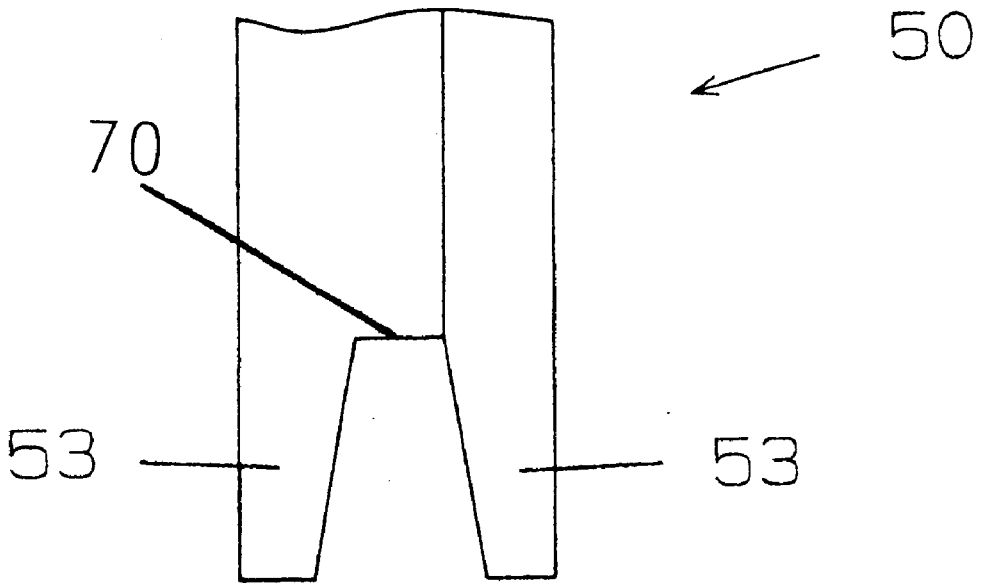
FIGS. 11(*a*) and 11(*b*) are a front and a bottom view of the jig 50, respectively.
Figure 11:
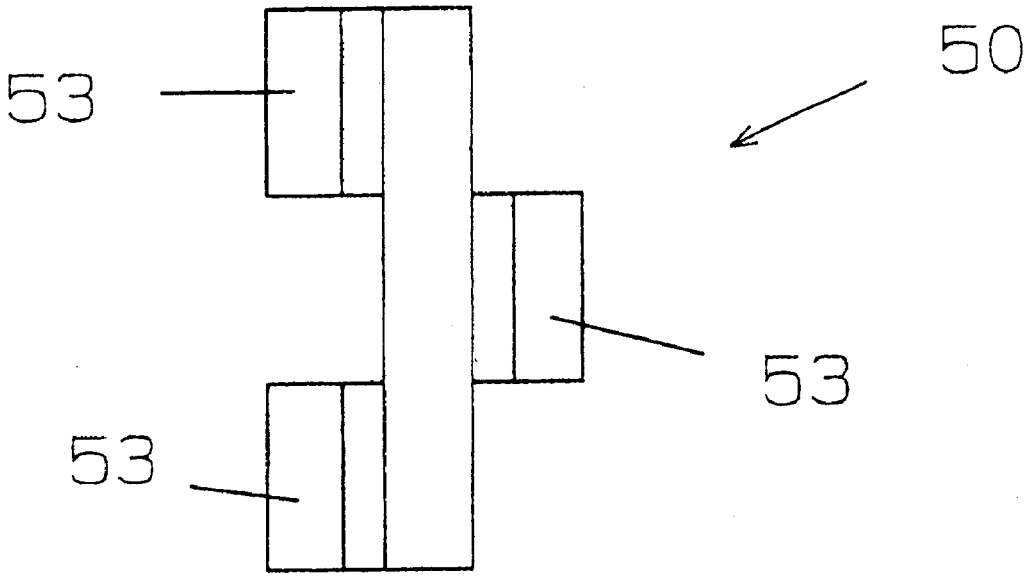
Figure 12:
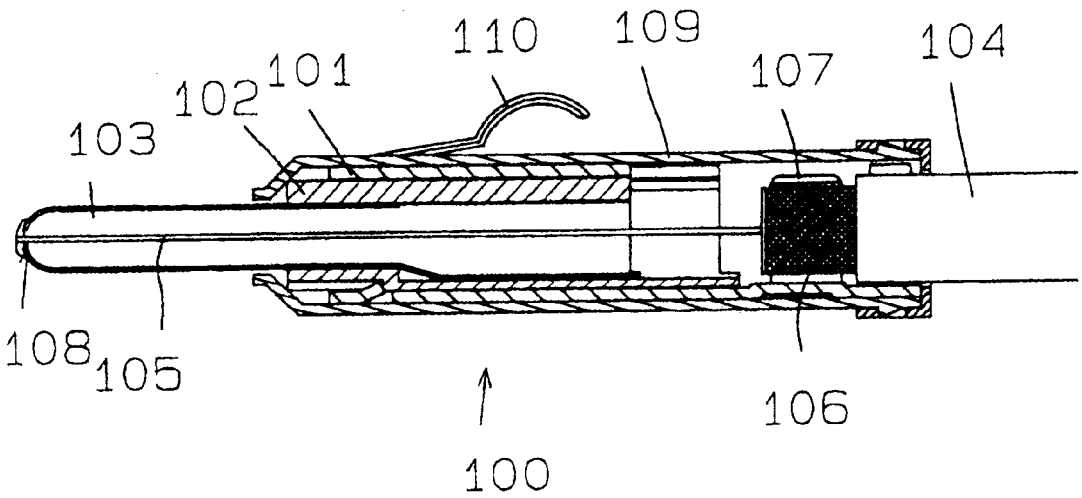
Fig. 12 PRIOR ART
FIG. 12 is a longitudinal sectional view depicting a conventional coaxial connector with a coaxial cable connected thereto.

Referring to FIGS. 5 and 11, jig 50 has downward projections 53 which straddle first and second contact pieces 12 and 13 when jig 50 is inserted through cutout 33. Central conductor 41 is straddled by projections 53 as jig 50 is inserted and is pushed down into position by a notched portion 70. Projections 53 push and separate first and second contact pieces 12 and 13 allowing central conductor 41 to be properly seated along center axis O. First and second contact pieces 12 and 13 resiliently grip central conductor 41 as jig 50 is removed.

Referring now to FIG. 10(*c*), shielded conductor 42 and external contact 2 are connected to each other by inserting inner clamping portion 21 between inner insulator 40 and shielded conductor 42. Next, outer clamping portion 22 and inner clamping portion 21 clamp shielded conductor 42 and inner insulator 40 together. As a result, shielded conductor 42 of coaxial cable 5 and external contact 2 of coaxial connector 1 are securely fixed and electrically connected to each other. Following this, sheath clamping portion 17 clamps the outer sheath of coaxial cable 5. This securely fixes coaxial cable 5 to external contact 2.

Referring now to FIGS. 9 and 10(*c*)–(*d*), once coaxial cable 5 is connected to external contact 2, coupling piece 24 is severed from carrier 27 at a position just behind sheath clamping portion 17. Inner clamping portion 21, once clamped, is firmly fixed by outer clamping portion 22 to coaxial cable 5 and will not fall out when coupling portion 24 is severed.

Figure 7:
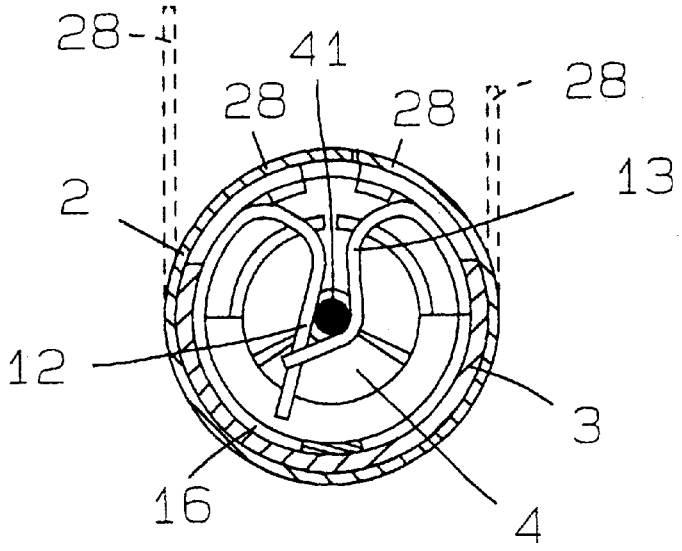
FIG. 7 is a cross sectional view of the coaxial connector, showing the connection part 11 covered with a cover piece 28 of an external contact 2.

Referring now to FIGS. 7 and 10(*e*), once the above has been accomplished, cover pieces 28 of external contact 2 are bent from the positions indicated by the broken lines along a radius of the cylindrical portion of external contact 2. In this way, cover pieces 28 cover the opening above connection part 11. This shields central conductor 41 from the outside and protects it against unwanted radiation and external noise. Then, insulating cover 7 is slid over external contact 2 from the front until the rearward end of cover 7 engages with insulating cap 8. Plug pin 4 projects out of through hole 52. Contact pieces 26 protrude through cutouts (not shown) in cover 7. Insulating cover 7 and insulating cap 8 are fixed to each other.

Coaxial connector 1 is connected to a mating connector (not shown.) Pin plug 4 makes contact with a central terminal (not shown) of mating connector. Contact piece 26 makes contact with a grounding terminal (not shown) of mating connector.

Because central conductor 41 of coaxial cable 5 is electrically connected to plug pin 4 of coaxial connector 1 by the resilient action of connection part 11, coaxial connector 1 is easily assembled to coaxial cable 5 without soldering and severing central conductor 41 as is required in the prior art. This reduces the manufacturing costs of coaxial connector 1.

Central conductor 41 of coaxial cable 5 is gripped by resilient first and second contact pieces 12 and 13 and is positioned in groove 15. This ensures that central conductor 41 is securely connected both mechanically and electrically. This arrangement prevents central conductor 41 from dislodging during use.

Because second contact piece 13 is bifurcated, two segments firmly grip central conductor 41 in combination with first contact piece 12 which is matingly disposed between the two segments. This ensures that connection between central conductor 41 and connection part 11 is secure and prevents central conductor 41 from dislodging during use.

While the above descriptions have utilized a plug pin (serving as a central contact) and a connection part that are integrally formed, it is not necessary that they be a unitary structure using the same material. One skilled in the art would recognize that they could be formed as separate parts as long as they are electrically connectable.

Furthermore, although groove 15 has been described to be defined by second contact piece 13, it may also be formed on first contact piece 12.

Additionally, jig 50 does not have to be used to place central conductor 41 in position. Central conductor 41 may be manually inserted axially into position after jig 50 pushes first and second contact pieces 12 and 13 apart. Contact pieces 12 and 13 are released to grip central conductor 41 in position. Outer clamping portion 22 may be crimped into position on shielded conductor 42 either before or after clamping central conductor 41. Although the preferred embodiment includes jig 50, it is possible to spread first and second contact pieces 12 and 13 using nonspecific tools such as a screwdriver or nail without departing from the scope or spirit of the invention.

Contact pieces 12 and 13 are not limited specifically to the configurations described above. Other examples of contact pieces include a trifurcated contact piece providing three segments matingly interengaging another bifurcated contact piece with the segments firmly received between them.

First and second contact pieces 12 and 13 matingly engage each other, bending central conductor 41 which locks it into position within groove 15. This ensures sufficient contact pressure is applied to central conductor 41. Because central conductor 41 is supported in groove 15, it will remain in position even if subjected to external forces.

Moreover, since connection part 11 is resiliently connected to central conductor 41 by utilizing the resiliency of a band-shaped metal sheet which extends over the entire length thereof, only a small amount of force is required to insert central conductor 41 into coaxial connector 1. Therefore, even if central conductor 41 is readily bendable, it can be connected to connection part 11. Furthermore, once connected, central conductor 41 bends between end portions of first and second contact pieces 12 and 13. This establishes electrical connections at a plurality of positions along central conductor 41. Hence, the reliability of the connection is increased.

There are many types of coaxial cables in use. Some coaxial cables lack an outer insulative covering. The invention works with all types of coaxial cables. On coaxial cables lacking an outer insulative layer, both outer clamping portion and cable sheath clamping portion are crimped around the outer conductive layer.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A coaxial connector comprising:

a plug pin having a connection part;

said connection part having at least first and second contact pieces that matingly interengage;

one of said first and second contact pieces having a bend forming a groove; and means for permitting urging of a central conductor against metal springback between said at least first and second contact pieces in a direction perpendicular to a longitudinal axis of said central conductor; whereby said central conductor is positionable in said groove between same, said central conductor is resiliently retained between said at least first and second contact pieces by said metal springback without requiring soldering for mechanical and electrical connection.

2. A coaxial connector according to claim 1, wherein said central conductor is deformed by said at least two contact pieces when said central conductor is positioned between same, whereby said central conductor resists axial forces therein.

3. A coaxial connector according to claim 1, wherein:

said connection part includes a groove;

said groove receiving said central conductor of a coaxial cable whereby said central conductor is aligned in said groove.

4. A coaxial connector according to claim 1 further comprising:

an insulative housing fitting over said plug pin;

an external contact fitting over said insulative housing whereby said external contact is electrically connectable to a shielding conductor of said coaxial cable; and said insulative housing electrically isolates said plug pin from said external contact.

5. A coaxial connector according to claim 4 further comprising:

an insulative covering fitting over said at least one external contact;

said external contact having at least one external contact surface; and said insulative covering having at least one opening whereby said at least one external contact surface is connectable to an external element through said opening.

6. A coaxial connector according to claim 5 further comprising:

access slots aligned with each other in said insulative housing, said external contact, and said insulative covering whereby an end portion of said central conductor is accessible therethrough.

7. A coaxial connector according to claim 6, further comprising:

a U-shaped bendable cover piece;

said U-shaped bendable cover piece bendable over said insulative covering to cover said access slots.

8. A coaxial connector according to claim 1 further comprising means for securing an outermost layer of said coaxial cable to said coaxial connector.

9. A coaxial connector according to claim 1, wherein:

at least one of said at least two contact pieces is bent in the shape of a U, whereby said at least two contact pieces matingly interengage near a center axis of said coaxial connector.

10. A coaxial connector according to claim 1, wherein said means for permitting urging a central conductor against a metal springback includes a removable jig.

11. A coaxial connector according to claim 1, wherein said first contact piece is bifurcated, providing substantially parallel segments with said second contact piece disposed between said segments.

12. A coaxial connector according to claim 1, wherein said one of said at least two contact pieces is bifurcated, providing substantially parallel segments with the other of said at least two contact pieces disposed between said segments.

13. A coaxial connector for attachment to a coaxial cable which has been prepared by stripping back an outer conductor exposing a portion of an inner conductor, comprising:

an external contact;

a plug pin coaxially disposed in said external contact;

means for electrically isolating said external contact from said plug pin;

said plug pin having a plug end extending beyond an end of said external contact;

said external contact having at least one external contact surface for contacting a socket;

said plug pin also having a connection part disposed at an other end;

said connection part having at least first and second contact pieces that matingly interengage;

one of said first and second contact pieces having a bend forming a groove; and means for urging a central conductor against metal springback between said at least first and second contact pieces in a direction to a longitudinal axis of said central conductor, whereby said central conductor is positionable between said groove of one of said first and second contact pieces and the other of said first and second contact pieces, said central conductor is resiliently retained between said at least first and second contact pieces without requiring soldering for mechanical and electrical connection.

14. A coaxial connector for attachment to a coaxial cable which has been prepared by stripping back an outer conductor to expose a portion of an inner conductor according to claim 13, wherein:

said connection part includes a groove; and said groove receiving said central conductor of a coaxial cable whereby said central conductor is aligned within said groove.

15. A coaxial connector for attachment to a coaxial cable which has been prepared by stripping back an outer conductor exposing a portion of an inner conductor according to claim 13, wherein:

said external contact is integrally formed of sheet metal which is bent substantially forming a cylinder; and said plug pin is integrally formed of sheet metal which is bent substantially forming a cylinder having a radius less than the radius of said external contact.

16. A coaxial connector for attachment to a coaxial cable which has been prepared by stripping back an outer conductor exposing a portion of an inner conductor according to claim 13, wherein:

said means for electrically isolating said external contact from said plug pin includes an insulative housing coaxially disposed between said external contact and said plug; and said insulative housing having an access hole for allowing access to said connection part.

17. A coaxial connector for attachment to a coaxial cable which has been prepared by stripping back an outer conductor exposing a portion of an inner conductor according to claim 11, wherein said first contact piece is bifurcated, providing substantially parallel segments with said second contact piece disposed between said segments.

18. A coaxial connector comprising:

a plug pin having a connection part;

said connection part having at least first and second contact pieces that resiliently interengage; and means for temporarily urging said at least two contact pieces apart forming a channel, whereby a central conductor is insertable in said channel and once said central conductor is inserted in said channel, said at least two contact pieces resilently move back together deforming said central conductor, resiliently retaining said central conductor against axial forces without requiring soldering for mechanical and electrical connection.

19. A coaxial connector according to claim 18, wherein:

one of said at least two contact pieces has a bend forming a groove; and said central conductor is held between said groove of one of said at least two contact pieces and the other of said at least two contact pieces.

* * * * *